US006289953B1

(12) United States Patent
Hasegawa

(10) Patent No.: US 6,289,953 B1
(45) Date of Patent: Sep. 18, 2001

(54) SPLITTING APPARATUS

(75) Inventor: Katsuji Hasegawa, Aichi-pref. (JP)

(73) Assignee: Meinan Machinery Works, Inc., Aichi-Ken (JP)

( * ) Notice: Subject to any disclaimer, the term of this patent is extended or adjusted under 35 U.S.C. 154(b) by 0 days.

(21) Appl. No.: 09/317,592

(22) Filed: May 24, 1999

(30) Foreign Application Priority Data

Jun. 1, 1998 (JP) ..... 10-169346

(51) Int. Cl.[7] ..... B27C 1/00

(52) U.S. Cl. ..... 144/175; 144/2.1; 144/158; 144/193.1; 144/184; 144/362; 144/366; 144/369

(58) Field of Search ..... 144/2.1, 4.9, 13, 144/158, 162.1, 175, 182, 184, 185, 193.1, 362, 366, 369, 3.1; 83/873

(56) References Cited

U.S. PATENT DOCUMENTS 3,407,855 * 10/1968 Ritchie ..... 144/193.1
4,289,179 * 9/1981 Koba ..... 144/2.1
4,718,338 * 1/1988 Koba ..... 144/362

FOREIGN PATENT DOCUMENTS

2112618 * 9/1972 (DE) ..... 144/366
H9-272102 10/1997 (JP) .
WO 8601452 * 3/1986 (WO) ..... 144/366

* cited by examiner

*Primary Examiner*—W. Donald Bray
(74) *Attorney, Agent, or Firm*—Morgan & Finnegan, LLP

(57) ABSTRACT

An apparatus for splitting a wood board into two separate sheets, comprising a pair of parallel drive shafts rotatable in the opposite directions, a series of toothed wheels fixed on each of the drive shafts at a predetermined spaced interval, each toothed wheel having on the circumferential periphery thereof a number of teeth incisingly engageable with the board, the toothed wheels on one of the drive shafts being disposed radially in alignment with the toothed wheels on the other drive shaft, respectively, a knife having a cutting edge positioned and directed to split the board from end to end into two separate sheets. The tip end portions of the teeth of each two radially aligned toothed wheels is formed to be positioned in an offset relation in the axial direction of the drive shafts by forming the tip end portion to have at least one surface which is bevel or oblique with respect to a plane extending radially of the toothed wheel.

9 Claims, 8 Drawing Sheets

SPLITTING APPARATUS

FIELD OF THE INVENTION

The present invention relates generally to a splitting apparatus and, more specifically to an apparatus for cutting a wood material in the form of a board or a sheet from end to end or along the grain by means of a knife so as to split the material into two separate layers of sheet. The wood material includes veneer, wood fiberboard such as MDF (medium density fiberboard), etc.

BACKGROUND OF THE INVENTION

For aiding in understanding of the invention, a typical conventional splitting apparatus will be described with reference to FIGS. 9 and 10.

The apparatus comprises a pair of drive shaft 1, 2 extending parallel one above the other and driven by a motor (not shown) at the same speed in opposite directions as indicated by two arrows. Each of the drive shafts 1, 2 has fixed thereon a plurality of toothed wheels 5, 6, respectively, which are spaced at a predetermined interval along the axial direction of the drive shafts 1, 2, and each of which wheels 5, 6 has a number of teeth 3, 4 projecting radially outward. As shown in FIG. 10, each of the teeth 3, 4 has an incising edge 3*a*, 4*a* whose tip end extends straight and parallel to the axes of the drive shafts 1, 2. The toothed wheels 5, 6 are arranged on the drive shaft 1, 2 such that a plurality of pairs of upper and lower toothed wheels 5, 6 is provided wherein the wheels of each pair are radially aligned with each other with the incising edges 3*a*, 4*a* of the teeth 3, 4 on the wheels 5, 6 set in facing relation, as shown in FIG. 10, in the region of passage between the upper and lower toothed wheels 5, 6 through which a wood fiberboard is moved. The toothed wheels 5, 6 are secured to the drive shafts 1, 2 by means of keys 5*a*, 6*a* formed in the inner periphery of the wheels 5, 6 and engaged with grooves 1*a*, 2*a* in the outer periphery of the drive shafts 1, 2.

In the case of the splitting apparatus of FIGS. 9 to 11, each toothed wheel 5, 6 has a thickness of about 2 mm and an outer diameter of about 135 mm as measured with respect to a circle described by the tip ends of the teeth 3, 4. The two drive shafts 1, 2 are spaced vertically so as to provide a space of about 1 to 2 mm between the two circles which are described by the tip ends of the teeth 3, 4 of the toothed wheels 5, 6. Thus, the passage region is formed between the toothed wheels 5, 6, through which the wood fiberboard P is moved forward, or from left to right as seen in FIG. 9, by engagement with the teeth 3, 4 of the rotating wheels 5, 6.

Between each two laterally adjacent toothed wheels 5, 6 is provided a pair of pressure bars 7, 8 located one above the other. These pressure bars 7, 8 are fixed at the proximal ends thereof to a frame (not shown) of the splitting apparatus and have the opposite distal ends located beyond an imaginary vertical line E passing through the axes of the drive shafts 1, 2. As shown in detail in FIG. 11 which is an enlarged view of a circle F in FIG. 9, the end portions of the pressure bars 7, 8 are formed with flat surfaces 7*a*, 8*a*, respectively, each having a length of about 2 mm as measured along the fiberboard moving direction and making an angle of about 1° with respect to a horizontal line passing perpendicularly to the imaginary line E so that the surfaces 7*a*, 8*a* provide slopes convergent as viewed in the moving direction of the fiberboard P and terminating at edges 7*b*, 8*b*. To be more specific, the slopes of the surfaces 7*a*, 8*a* are formed such that the edges 7*b*, 8*b* are spaced vertically at a distance corresponding to about 90% of the thickness of the fiberboard P to be split.

The apparatus further includes a splitting knife 9 fixed to the frame of the apparatus and extending in axial direction of the drive shafts 1, 2 with its cutting edge positioned adjacent the pressure bars 7, 8 and directed against the moving direction of the fiberboard P. The knife 9 has about 24° of cutting angle and is disposed centrally with respect to the upper and lower toothed wheels 5, 6 so that the fiberboard P is split into two halves Pa, Pb or two separate layers of sheets having substantially the same thickness which is half the thickness of the material fiberboard P.

Between each two laterally adjacent toothed wheels 5, 6 on the downstream side thereof is provided a pair of separating bars 10, 11 located one above the other and having the proximal end thereof fixed to the frame of the splitting apparatus and the opposite distal end located adjacent to the knife 9. As shown in FIG. 9, the separating bars 10, 11 have surface 10*a*, 11*a* extending to intersect imaginary circles described by the tip ends of the teeth 3, 4 of the respective toothed wheels 5, 6 such that an obtuse angle is formed between these surface 10*a*, 11*a* and tangential lines of the above circles at the points of intersection, respectively.

A feeding conveyer 12, which is driven to travel at a speed corresponding to the peripheral speed of the toothed wheels 5, 6 at the tip ends of their teeth 3, 4, is disposed on the upstream side of the toothed wheel 5, 6 for feeding the fiberboard P, and two delivery conveyers 13, 14 are located on the downstream side adjacent to the separating bars 10, 11 for outfeeding split sheets Pa, Pb.

In operation of the above-described apparatus, the fiberboard P placed on the feeding conveyer 12 is moved toward the passage region between the toothed wheels 5, 6, where the fiberboard P is pierced or incised on both sides thereof by the teeth 3, 4 of the rotating wheels 5, 6, so that the fiberboard P is continued to move through the passage. As the fiberboard P is thus moved, its leading end is brought against the cutting edge of the stationary knife 9. As seen from FIG. 9, the cutting edge of the knife 9 is applied to the center of the fiberboard P as viewed across its thickness. As a result, the fiberboard P fed against the knife 9 is split by the knife 9 into to two separate sheets Pa, Pb with substantially the same thickness.

During the above splitting operation, the fiberboard P is pressed firmly from both top and bottom by the pressure bars 7, 8 at a position immediately preceding the cutting edge of the knife 9 for preventing a so-called presplit in the fiberboard P, thus making it possible to produce smooth split surfaces on the resulting sheets Pa, Pb. The split sheets Pa, Pb are pulled apart by the teeth 3, 4 of the rotating wheels 5, 6, moving past the tip end portion of the knife 9 along part of the periphery of the wheels 5, 6, until the sheets Pa, Pb are separated or removed successively from the teeth 3, 4 by the separating bars 10, 11 as shown in FIG. 9. The sheets Pa, Pb are guided onto the delivery conveyers 13, 14, respectively, and transferred to any subsequent process.

As an application of the resulting sheet Pa, Pb, it may glued, for example, to a plywood panel having a relatively rough surface in order to provide it with a smooth surface to which a decorative sheet such as sliced veneer sheet or vinyl chloride sheet is further laminated. The resulting product may be used as house interior materials such as flooring.

In the above-described conventional splitting apparatus, wherein the upper and lower toothed wheels 5, 6 or each pair are radially aligned and a number of teeth 3, 4 each having a straight edge 3*a*, 4*a* are provided circumferentially at a relatively short interval, the teeth 3, 4 on the toothed wheels 5, 6 tend to be brought into a harmful contact thereby to cause a breakage to the teeth 3, 4, for example, when the drive shafts 1, 2 on which the toothed wheels 5, 6 are mounted are caused to be bent by any force created during the splitting operation. Breakage of any teeth 3, 4 may cause a failure in transmission of force from the drive shafts 1, 2 to the fiberboard P via the toothed wheels 5, 6, so that splitting cannot be accomplished successfully. Accident of the above contact between the teeth 3, 4 may be forestalled by providing a space of at least about 1 mm between the two circles defined by the tip ends of the teeth 3, 4 of the wheels 5, 6.

For example, in handling a fiberboard with a relatively small thickness of about 1.5 mm with the above spacing set at about 1 mm, the teeth 3, 4 cannot incise sufficiently deep into the fiberboard for steady feeding and, therefore, successful splitting cannot be accomplished. When splitting a relatively hard fiberboard, the teeth 3, 4 cannot incise sufficiently deep into the fiberboard, either.

The above problems may be solved by arranging such that the toothed wheels 5, 6 are set off from each other in the axial direction of the drive shaft 1, 2 or disposed in a staggered manner so that the teeth 3, 4 on the wheels 5, 6 do not face each other in the board passage region and hence have little chance of tooth-to-tooth contact. In such an arrangement of the toothed wheels 5, 6, however, the top and bottom pressure bars 7, 8 of each pair must be disposed accordingly in an offset relation to each other. In such a disposition of the pressure bars 7, 8, the fiberboard P cannot be pressed firmly enough to produce smooth split surfaces on the resulting sheets Pa, Pb.

SUMMARY OF THE INVENTION

In order to solve the above problems, the present invention provides an apparatus for splitting a wood board into two separate sheets, comprising a pair of drive shafts disposed one above the other, extending parallel to each other and rotatable on the axes thereof in the opposite directions, a series of toothed wheels fixedly mounted on each of the pair of drive shafts at a predetermined spaced interval in the axial direction of the drive shafts, each toothed wheel having on the circumferential periphery thereof a number of teeth incisingly engageable with the board for moving t he board between the upper and lower toothed wheels, the toothed wheels on one of the drive shafts being disposed radially in alignment with the toothed wheels on the other drive shaft, respectively, pressure means provided between each two adjacent toothed wheels on each of the drive shafts for applying pressure to the board from both top and bottom, a knife extending in the axial direction of the drive shafts and having cutting edge which is positioned adjacent to the pressure means and directed so as to split the board into two separate sheets, and means for separating the two split sheets from engagement with the teeth of the toothed wheels, wherein the tip end portions of the teeth of each two radially aligned toothed wheels is formed to be positioned in an offset relation in the axial direction of the drive shafts.

The above offset disposition of th e tip end portions of the teeth of each two radially aligned toothed wheel is accomplished by forming the tip end portion to have at least one surface which is bevel or oblique with respect to a plane extending radially of the toothed wheel and by mounting the two radially aligned toothed wheel on the drive shaft in such an orientation that the bevel surfaces of the teeth of the above two toothed wheels face in ward each other.

According to the present invention, the teeth of each two radially aligned toothed wheels may be formed so as to project radially outward to such an extent that the tip end portions of the teeth overlap for a distance, for example about 0.7 mm, in the region where the board is moved between said two toothed wheels so that the teeth incise deep into the board beyond its thickness center.

By so constructing the apparatus, damaging contact between the teeth caused by bending of the drive shafts or for any other reason can be prevented successfully and also a relatively thin board can be incised deep enough by the teeth for stabilized movement of the board and, therefore, smooth surfaces with acceptable quality can be produced on the two split sheets.

The above and other objects, features and advantages of the invention will become apparent to those skilled in the art from the following description of embodiments of the veneer reeling apparatus according to the present invention, which description is made with reference to the accompanying drawings, wherein:

DESCRIPTION OF EMBODIMENTS

Figure 10:
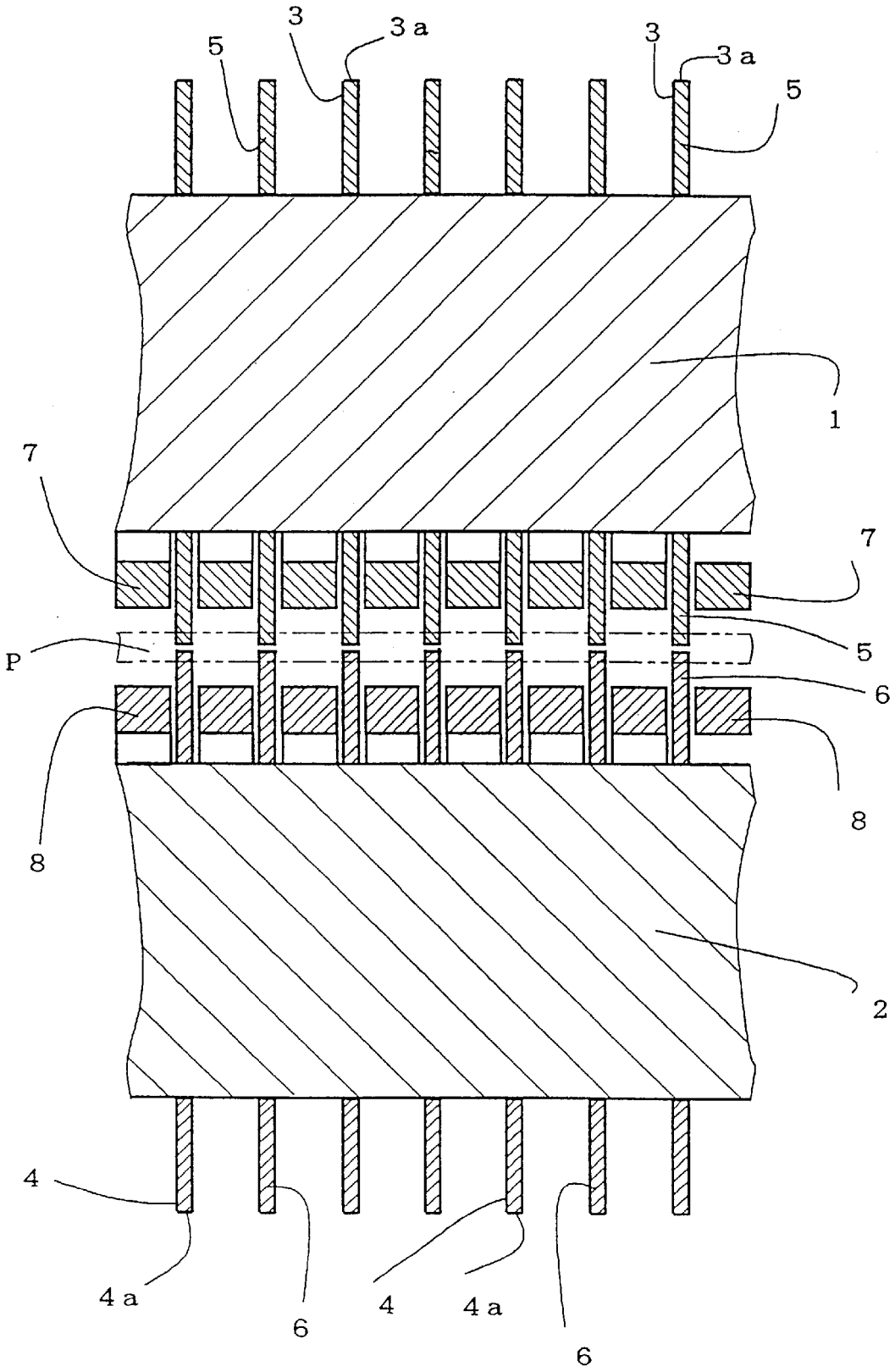
FIG. 10 a fragmentary sectional view taken along line E—E of FIG. 9.
Figure 11:
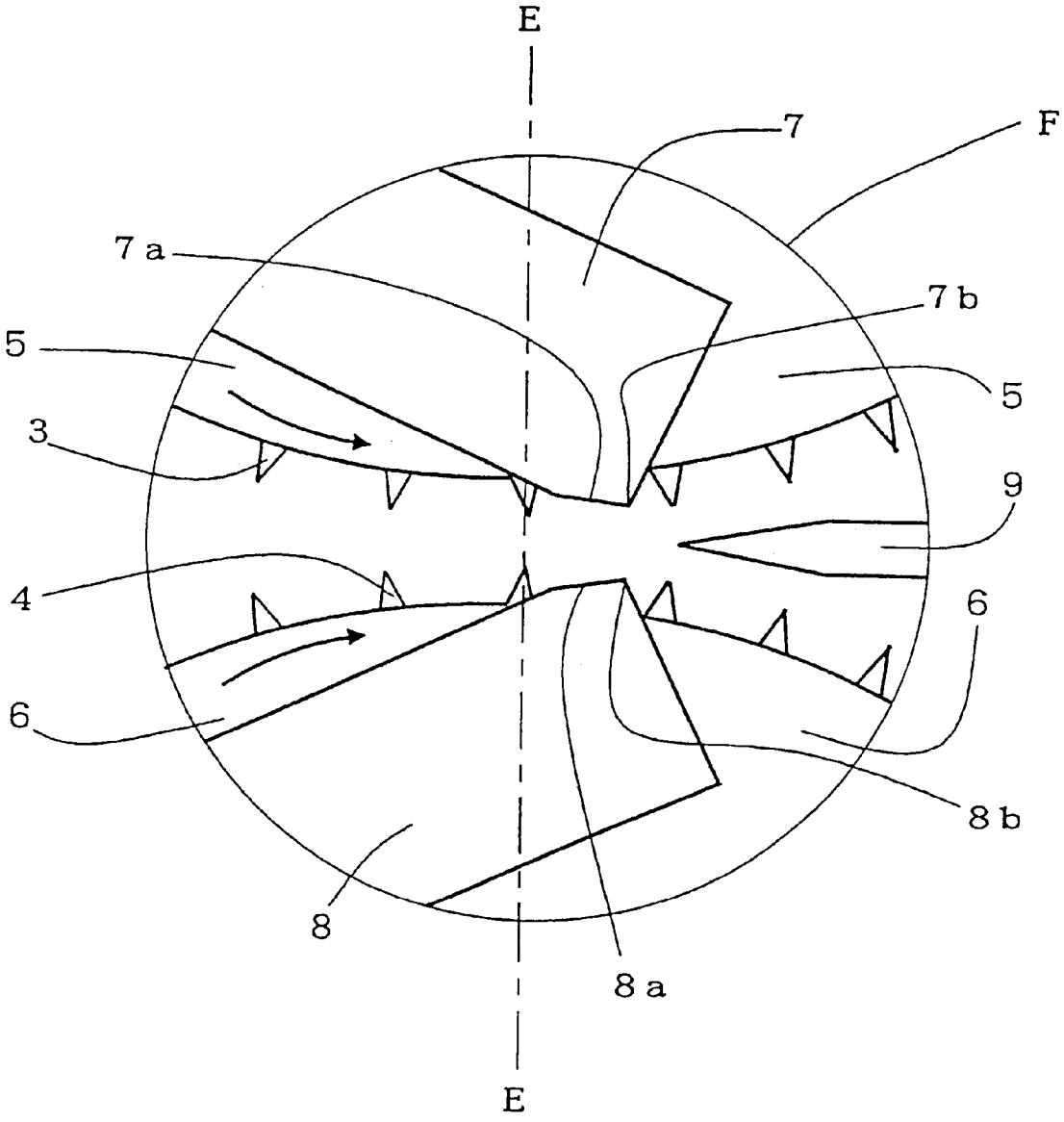
FIG. 11 is an enlarged view of a circle F of FIG. 10.

The following will describe a preferred embodiment of the present invention while having reference to the accompanying drawings including FIGS. 1 through 5. Since elements or parts of the apparatus of the invention other than those corresponding to the toothed wheels 5, 6 and their teeth 3, 4 are substantially the same as the corresponding elements or parts of the conventional apparatus of FIGS. 9, 10 and 11, these are denoted by like reference symbols and their detailed description will be omitted.

Figure 3:
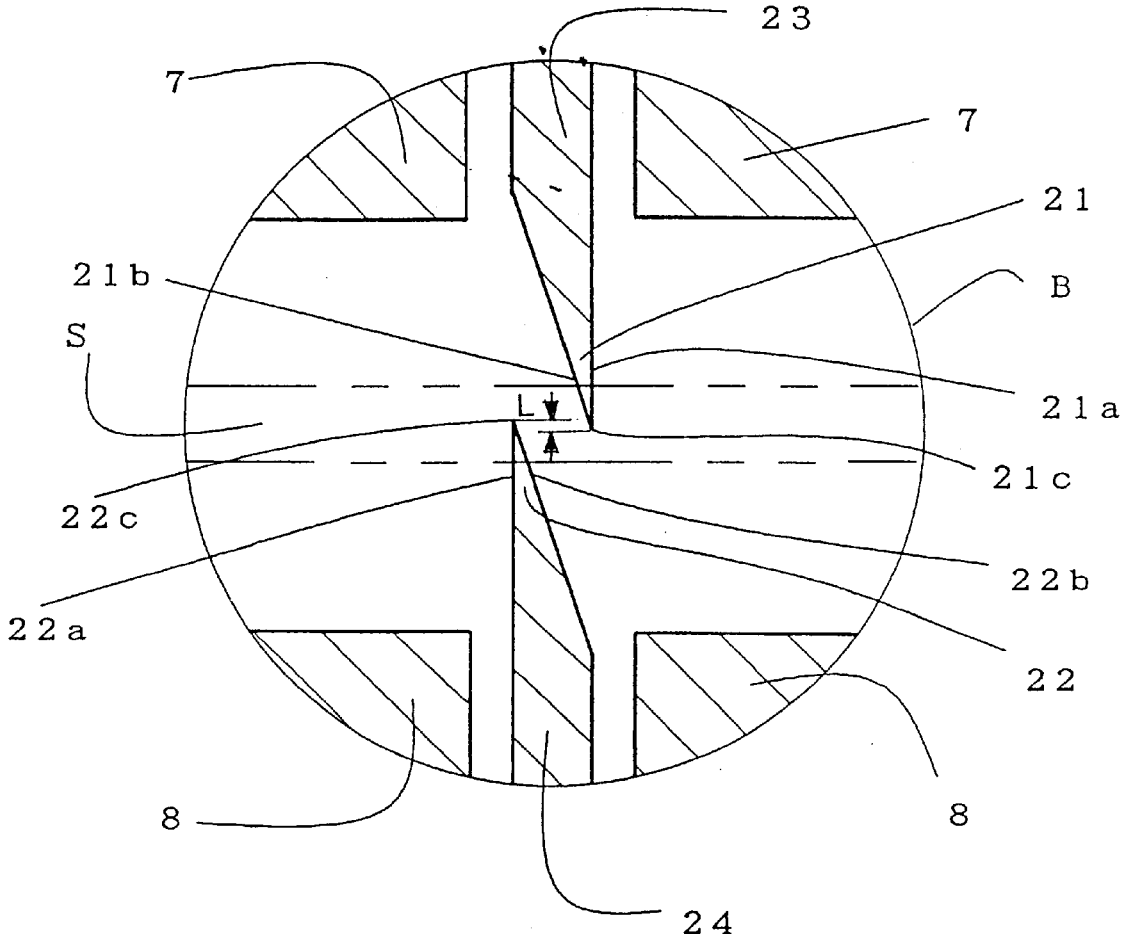
FIG. 3 is an enlarged view of a circle B of FIG. 1.
Figure 4:
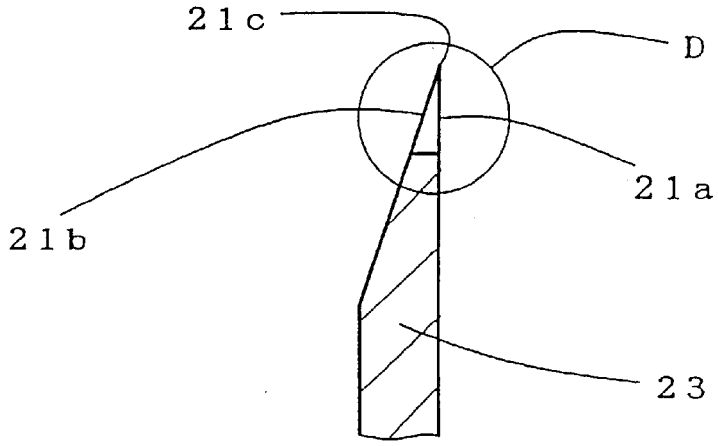
FIG. 4 is a sectional view of a toothed wheel taken along line Y—Y of FIG. 1.
Figure 5:
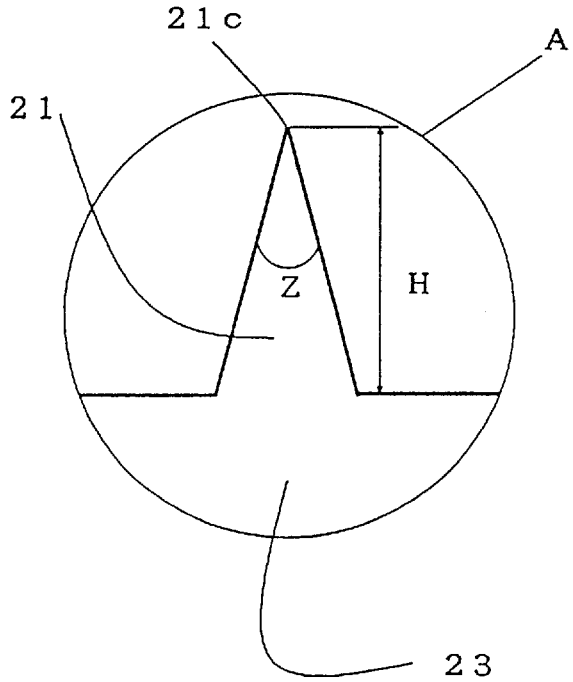
FIG. 5 is an enlarged view of a circle A of FIG. 1.
Figure 9:
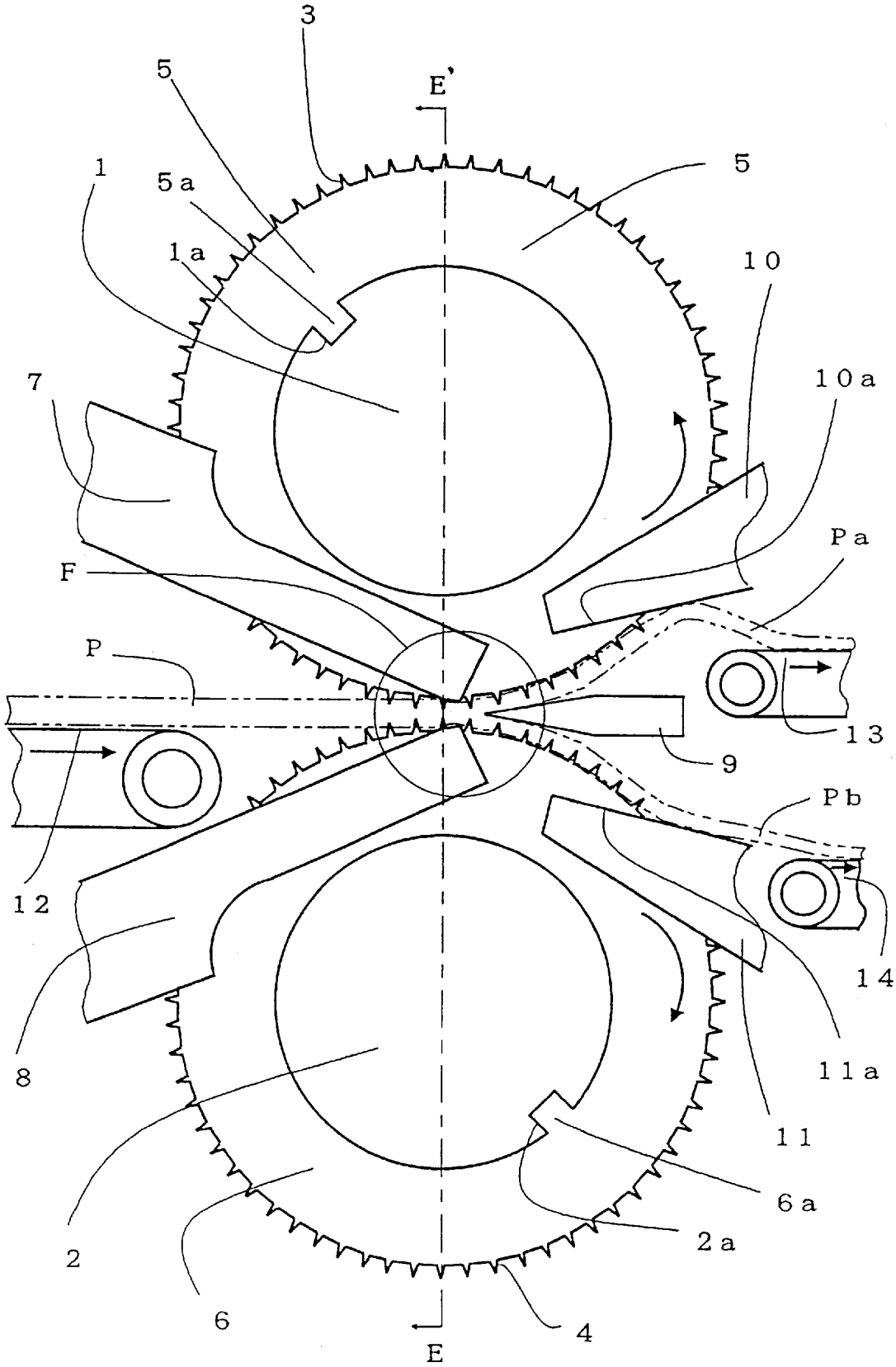
FIG. 9 is a fragmentary side view of a conventional splitting apparatus.

In the embodiment of FIGS. 1 through 5, the slopes of the surfaces 7*a*, 8*a* of the pressure bars 7, 8 are formed such that edges 7*b*, 8*b* thereof are spaced vertically at a distance corresponding to about 90% of the thickness of the fiberboard S to be split as in the case of FIG. 9. Each of the toothed wheels 23, 24 has a thickness of about 2 mm and an outer diameter of about 135 mm as measured at the tip end of their teeth 21, 22. Referring to FIG. 5, each of the teeth 21 on the toothed wheel 23 has a height H of about 2.5 mm and an angle Z, or an angle as viewed from a lateral side of the wheel 23, of about 30°. These teeth 21 are formed on the wheel 23 at spaced intervals of about 5 mm. The same is true of the teeth 22 on the wheel 24.

Figure 1:
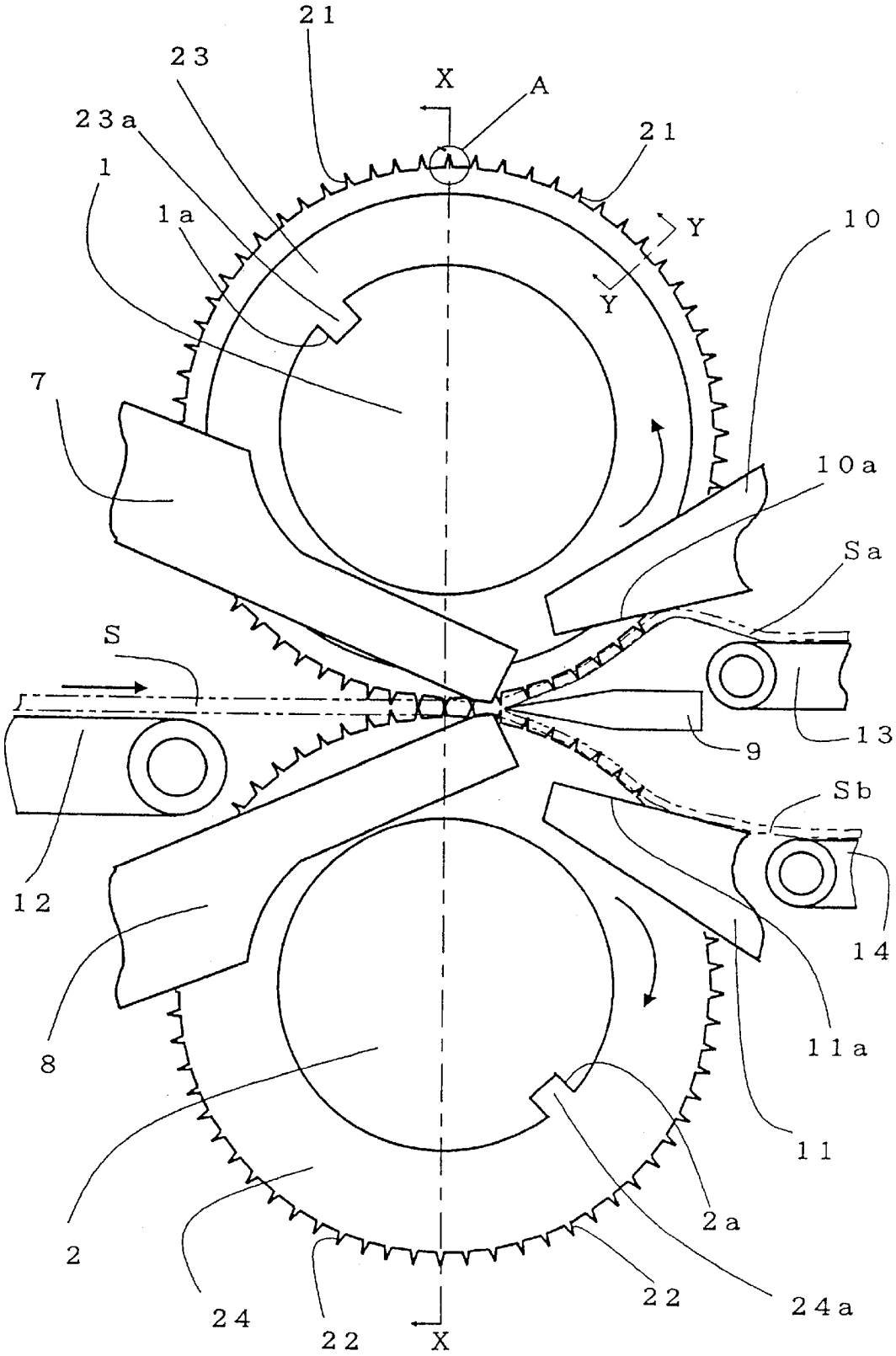
FIG. 1 is a fragmentary side view of a splitting apparatus of the present invention.
Figure 2:
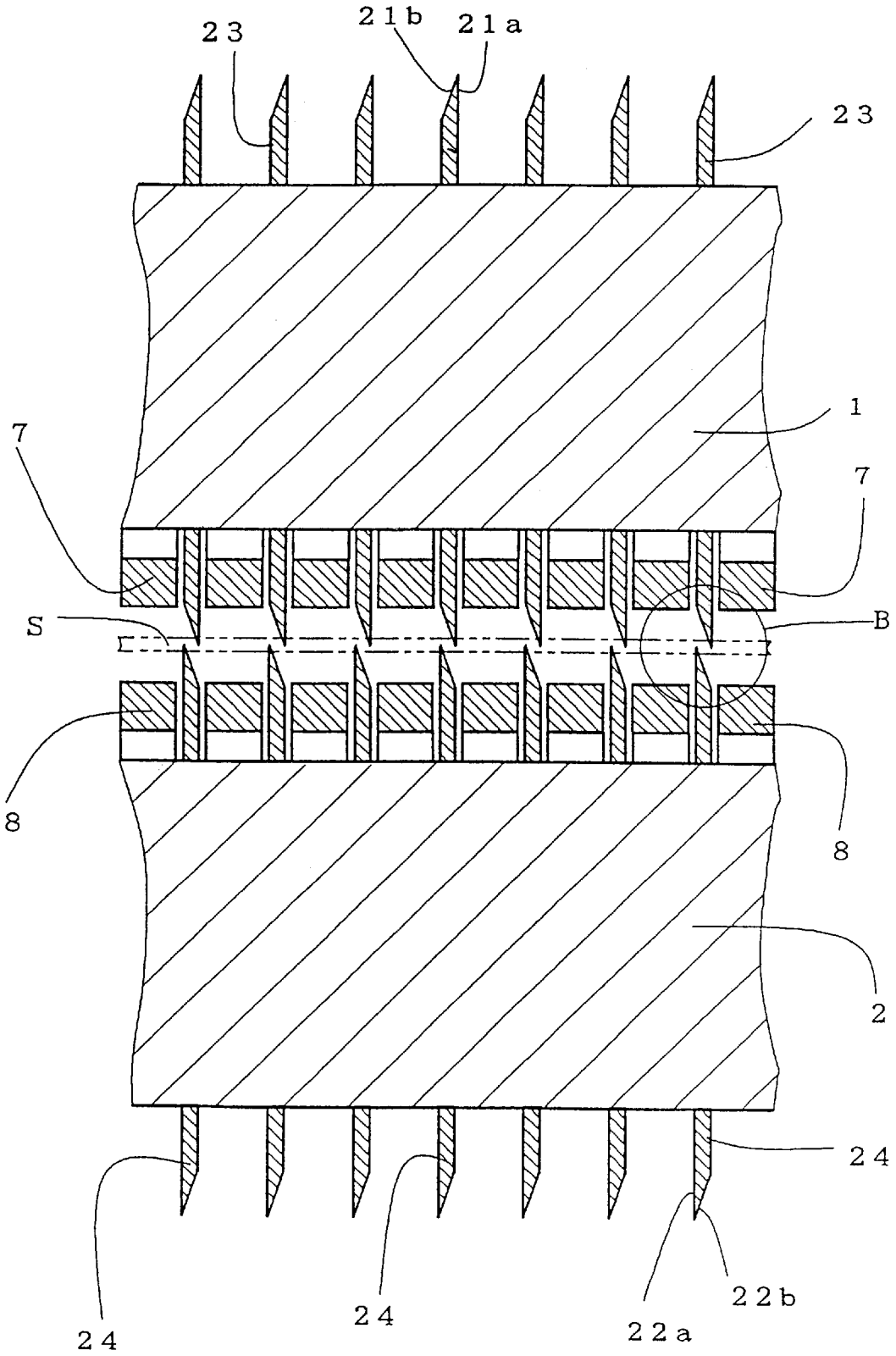
FIG. 2 is a fragmentary sectional view taken along line X—X of FIG. 1.

Referring specifically to FIGS. 2, 3 and 4, the tooth 21 of the upper toothed wheel 23 has a vertical surface 21*a* extending radially and a bevel or oblique surface 21*b* making an angle of about 20° with the vertical surface thereby forming a sharp pointed incising edge 21*c*. Likewise, the tooth 22 of the toothed wheel 24 has a vertical surface 22*a* and a bevel surface 22*b* making an angle of about 20° thereby forming a pointed incising edge 22*c*. As shown clearly in FIGS. 3 and 4, the upper and lower toothed wheels 23, 24 of each pair are mounted on the drive shafts 1, 2 in such an orientation that the bevel surfaces 21*b*, 22*b* of the teeth 21, 22 face inward or toward each other so that their tip ends 21*c*, 22*c* are positioned in an outwardly offset relation in the axial direction of the drive shafts 1, 2.

As seen in FIG. 3, the teeth 21, 22 are shown to project radially outward to such an extent that their tip end portions overlap for a distance of about 0.7 mm as indicated by L, with the result that the teeth 21, 22 incise deep into the fiberboard S beyond its thickness center.

As in the conventional apparatus, the toothed wheels 23, 24 are secured to the drive shafts 1, 2 by means of keys 23*a*, 24*a* formed in the inner periphery of the wheels and engaged with grooves 1*a*, 2*a* in the outer periphery of the drive shaft 1, 2.

In operation, a fiberboard S with a thickness of about 2.7 mm placed on the feeding conveyer 12 is moved forward to the passage region between the toothed wheels 23, 24, where the fiberboard S is pierced from both top and bottom by the teeth 3, 4 of the rotating wheels 23, 24 so that it is continued to move forward in the passage region. As the fiberboard S moves through the passage while being pressed from both top and bottom by the pressure bars 7, 8, it is cut from end to end by the knife 9 into two separate two sheets Sa, Sb as in the conventional splitting apparatus.

Apparently in the above splitting operation, the teeth 21, 22 incise deeper into the fiberboard S than in the case of the conventional apparatus. That is, the teeth 21, 22 incise into the board beyond the its thickness center, as most clearly shown in FIG. 3, without interfering with each other because of the offset disposition of the tip end portions of the teeth 21, 22. This offset arrangement is effective to prevent the aforementioned harmful contact of the teeth 21, 22 which may otherwise be caused by bending of the drive shafts 1, 2 or bending of any one of the teeth 21, 22 itself toward its counterpart due to application thereto of any abnormal force during the splitting operation.

In the structure according to the invention wherein toothed wheels of each pair are disposed in radial alignment with each other, one of the pressure bars 7, 8 of a pair can be provided immediately above the other as in the conventional apparatus and, therefore, the fiberboard S is pressed in an optimum condition from both top and bottom to make possible stabilized splitting operation.

The present invention may be practiced in other forms than the above embodiment, as exemplified below.

While each of the teeth 21, 22 has formed between the vertical surface 21*a* and the bevel surface 21*b* thereof an angle of about 20°, this angle may be changed to anywhere from 10° to 30°. Likewise, the angle Z shown in FIG. 5 may be selected from between 20° and 50°.

Figure 6:
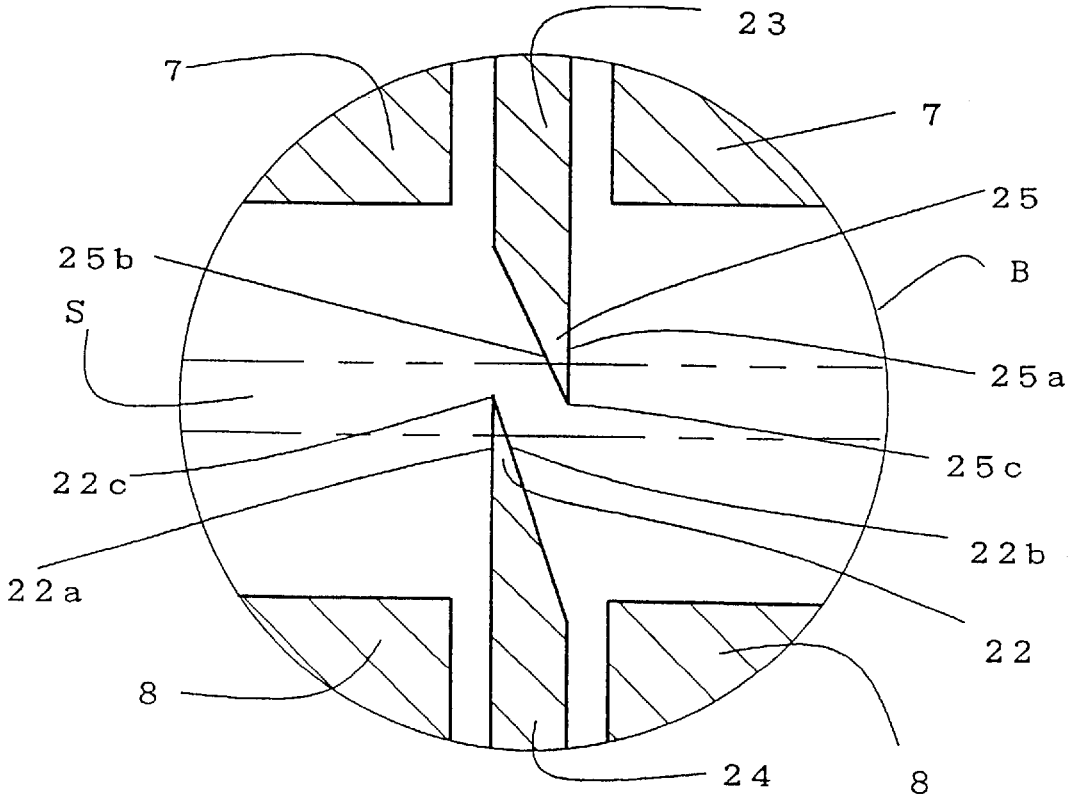
FIG. 6 is similar to FIG. 3, but showing a modified embodiment according to the present invention.

The teeth 21, 22 of the toothed wheels 23, 24 do not necessarily have to be identical in cross section specifically at the tip end portions thereof, but the teeth may be shaped in any way insofar as their tip end portions are disposed in an offset relation in the axial direction of the drive shafts 1, 2. FIG. 6 shows an example in which the angle of the tooth 25 made between its vertical plane 25*a* and the bevel plane 25*b* is greater than the angle of the tooth 22 made between its planes 22*a* and 22*b*.

Figure 7:
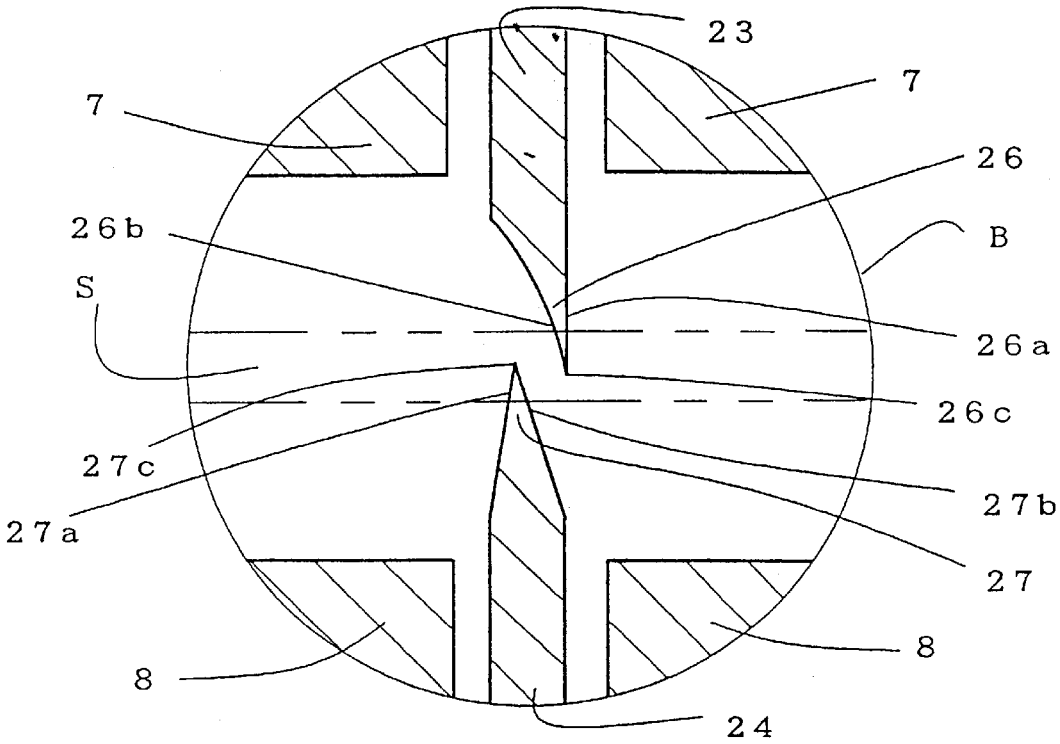
FIG. 7 is also similar to FIG. 3, but showing another modified embodiment according to the present invention.

As shown in FIG. 7, the toothed wheel 23 may have a tooth 26 having a curved surface 26b instead of the straight surface 21*b*. In combination with the tooth 26 or the tooth 25 (FIG. 6), a tooth 27 having bevel surfaces 27*a*, 27*b* on opposite sides may be used.

Figure 8:
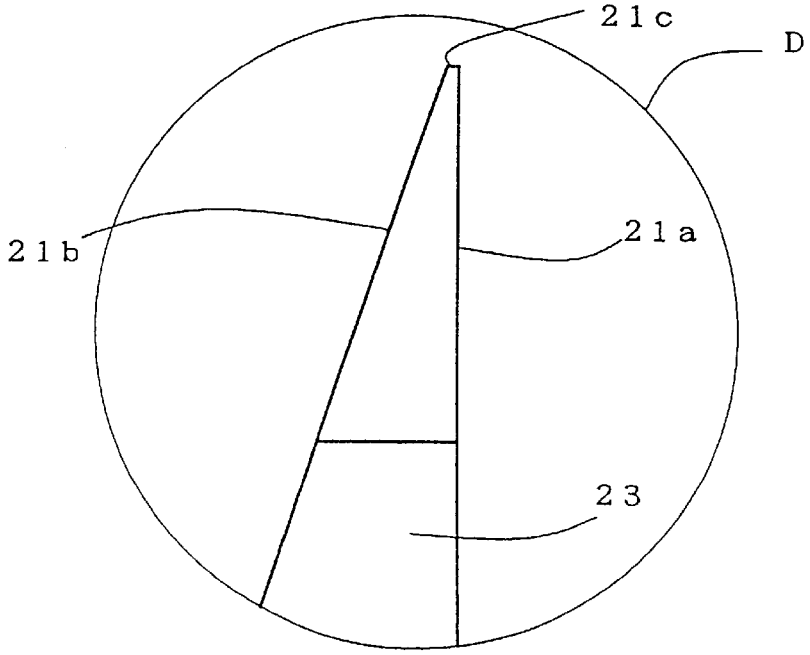
FIG. 8 is an enlarged view of a circle D of FIG. 4.

While each of the teeth 21, 22 is formed to present a sharp pointed edge as indicated in FIG. 4, the tooth may be formed to have a flat portion, as shown in FIG. 8, with a width of about 0.5 mm.

It is noted that the teeth 21, 22 do not necessarily project radially outward to such an extent as shown in FIG. 3, but only to such a degree that a space is be formed between the circles described by the tip ends of the teeth.

The splitting knife 9 may be fixed at a position where the fiberboard S is split into two sheets having different thicknesses if it is desired to produce such sheets.

In the above-described embodiment, the pressure bars 7, 8 may be replaced by rotatable pressure rolls to reduce the friction between the pressure means and the surfaces of the fiberboard S.

While the invention has been described and illustrated with reference to the specific embodiments, it is to be understood that the invention can be practiced in other various changes and modifications without departing from the spirit or scope thereof.

What is claimed is:

1. An apparatus for splitting a wood board into two separate sheets comprising:

a pair of drive shafts disposed one above the other, extending parallel to each other and rotatable on axes thereof in the opposite directions;

a series of toothed wheels fixedly mounted on each said pair of drive shafts at a predetermined spaced interval in the axial direction of said drive shafts, each having on the circumferential periphery thereof a number of teeth incisingly engageable with the board for moving the board between the upper and lower toothed wheels, the toothed wheels on one of said drive shafts being disposed radially in alignment with the toothed wheels on the other drive shaft, respectively;

pressure means provided between each two adjacent toothed wheels on each of said drive shafts for applying pressure to the board from both top and bottom;

a knife extending in the axial direction of said drive shafts and having cutting edge positioned adjacent to said pressure means and directed so as to split the board into two separate sheets; and means for separating said two split sheets from engagement with the teeth of said toothed wheels;

said tip end portions of the teeth of each two radially aligned toothed wheels being formed to be positioned in an offset relation in the axial direction of said drive shafts, wherein the tip end portion of each tooth is formed with at least one surface which is bevel or curved with respect to a plane extending radially of the toothed wheel.

2. A splitting apparatus according to claim 1, wherein said two radially aligned toothed wheels are mounted on said drive shafts, respectively, in such an orientation that the bevel surfaces of the teeth of said two toothed wheels face inward each other so that said tip end portions are positioned in an outwardly offset relation in the axial direction of said drive shafts.

3. A splitting apparatus according to claim 2, wherein said bevel surface of the tooth makes an angle between 10° and 30° with said radially extending plane.

4. A splitting apparatus according to claim 2, wherein said bevel surface of the tooth makes an angle of about 20° with said radially extending plane.

5. A splitting apparatus according to claim 2, wherein the teeth of said each two radially aligned toothed wheels project radially outward to such an extent that the tip end portions of the teeth overlap for a predetermined distance in the region where the board is moved between said two toothed wheels.

6. A splitting apparatus according to claim 2, wherein the teeth of said each two radially aligned toothed wheels project radially outward to such an extent that the teeth incise deep into the board beyond its thickness center.

7. A splitting apparatus according to claim 1, wherein each of said teeth terminates at a pointed tip end.

8. A splitting apparatus according to claim 1, wherein each of said teeth terminates at a tip end which is formed with a flat portion.

9. A splitting apparatus according to claim 1, wherein the tip end portion of the tooth of at least one of said two radially aligned toothed wheels is formed with two surfaces which are beveled with respect to a plane extending radially of the toothed wheel.

* * * * *